US005570914A

United States Patent [19]

Hughes

[11] Patent Number: 5,570,914

[45] Date of Patent: Nov. 5, 1996

[54] EARTHQUAKE ACTUATED DOOR LATCH

[76] Inventor: Harry H. Hughes, 786 Trenton Dr., Sunnyvale, Calif. 94087-2253

[21] Appl. No.: 503,459

[22] Filed: Jul. 17, 1995

[51] Int. Cl.[6] ..... E05C 19/12

[52] U.S. Cl. ..... 292/130; 292/230; 292/DIG. 65

[58] Field of Search ..... 292/230, 231, 292/232, 233, 234, 235, 236, 237, 238, 239, DIG. 65, 130, 131, 134, 136

[56] References Cited

U.S. PATENT DOCUMENTS

| | | | |
|---|---|---|---|
| 2,970,000 | 1/1961 | Moore | 292/238 |
| 3,642,314 | 2/1972 | Smith et al. | 292/134 |
| 3,828,899 | 8/1974 | Scott | 190/41 R |
| 4,429,704 | 2/1984 | Jones | 137/45 |
| 4,546,660 | 10/1985 | Bujold | 74/2 |
| 4,613,298 | 9/1986 | Harada et al. | 431/88 |
| 5,035,451 | 7/1991 | Brady | 292/96 |
| 5,042,856 | 8/1991 | Goodman | 292/259 R |
| 5,090,753 | 2/1992 | Goodman | 292/230 |
| 5,152,562 | 10/1992 | Stevenson et al. | 292/252 |
| 5,201,434 | 4/1993 | DeVivo et al. | 220/315 |
| 5,224,744 | 7/1993 | Michelutti | 292/234 |
| 5,312,143 | 5/1994 | Buckner | 292/230 |
| 5,415,314 | 5/1995 | McCollum | 220/315 |
| 5,419,598 | 5/1995 | Kreitzer | 292/230 |
| 5,474,341 | 12/1995 | Putman et al. | 292/230 |
| 5,529,352 | 6/1996 | Chin | 202/230 |

*Primary Examiner*—Steven N. Meyers
*Assistant Examiner*—Donald J. Lecher

[57] ABSTRACT

The Earthquake Actuated Door Latch mounts outside a cabinet or beside the cabinet door. The device contains a pivoted catch assembly with a weight on one end and a door catch, or hook, on the other. The catch assembly is stable in two positions, one on each side of the cabinet door. An earth tremor causes the weight to shift out of the cocked position to the operated position (the second stable position) putting the hook where it interferes with opening of the cabinet door. Weight and hook move as a unit, minimizing delay, and an internal lock prevents rebound.

3 Claims, 4 Drawing Sheets

EARTHQUAKE ACTUATED DOOR LATCH

BACKGROUND OF THE INVENTION

1. Field of the Invention

This invention relates to cabinet door latches, specifically a latch to prevent a door from opening as a result of an earthquake.

2. Description of the Prior Art

Modern cabinet door closures are made for ease of operation and many will not hold securely through earth tremors. Examples of easily opened closures are magnetic latches and spring hinges. Child-proof locks are sometimes installed to protect against earthquakes, resulting in loss of ease of operation. An Earthquake Actuated Door Latch will hold a door closed during an earth tremor without causing loss of the ease of operation of modern door closures. The following U.S. patents are considered by the applicant to be related:

U.S. Pat. No. 5,312,143 May 17, 1994 Bucker

U.S. Pat. No. 5,152,562 Oct. 6, 1992 Stevenson & Simpson

U.S. Pat. No. 5,035,451 Jul. 30, 1991 Brady

Buckner's device mounts inside the cabinet on a shelf, occupying storage space and possibly interfering with stocking of the cabinet. A finger must be inserted through a narrow door gap to release the latch after it has operated, and it requires a tool to accomplish the reset. A tremor moves a weight and after the weight reaches the right position a spring-operated latch is released to hook the door. The door could open before these two occurrences are completed.

Stevenson and Simpson 's device, when used with kitchen cabinets, is limited to inside mounting. Like Buckner's it occupies storage space and might interfere with stocking of the cabinet. Release of the door requires insertion of a finger or tool inside the narrow door gap to manipulate the latch. Reset takes two actions, one to reinsert the latch engaging member and one to reach behind the housing to pull the ball back in place. Sensitivity to sideward motions is poor because there is nothing to eject the ball from its cavity if there is no forward-backward motion. Action might be too slow since the ball must travel from the cavity to the slot in the engaging member. A door could open before this is completed.

Brady's design will not respond to side-to-side motion. If something stored on a shelf were to fall over and roll against the door due to sideward motions, the latch would not operate and things could spill out. His device also mounts inside the cabinet. Some people may prefer a visible latch easily accessible from the outside.

The previously patented devices are difficult to install, are not acceptable for mounting on the outside of kitchen cabinets, reset after operation is inconvenient, and they occupy storage space inside the cabinet.

SUMMARY

This design responds instantly to cabinet motion through inertia of a weight attached to a catch assembly. If the weight moves relative to the cabinet, the catch assembly moves simultaneously to block the door from opening. The catch assembly operates in response to sideways or forward/backward motion or any combination thereof. There is negligible friction involved in latch operation. The latch may be mounted above or beside either flush or overlapping doors on the outside of the cabinet. Installation is simple. Reset after operation is easy and can be done with one hand. No secondary action takes place as with spring release followed by catch movement or a ball falling from a platform into a socket. No internal cabinet space is occupied by this unit. The design is unique, totally different than previously patented designs.

Figure 1A:
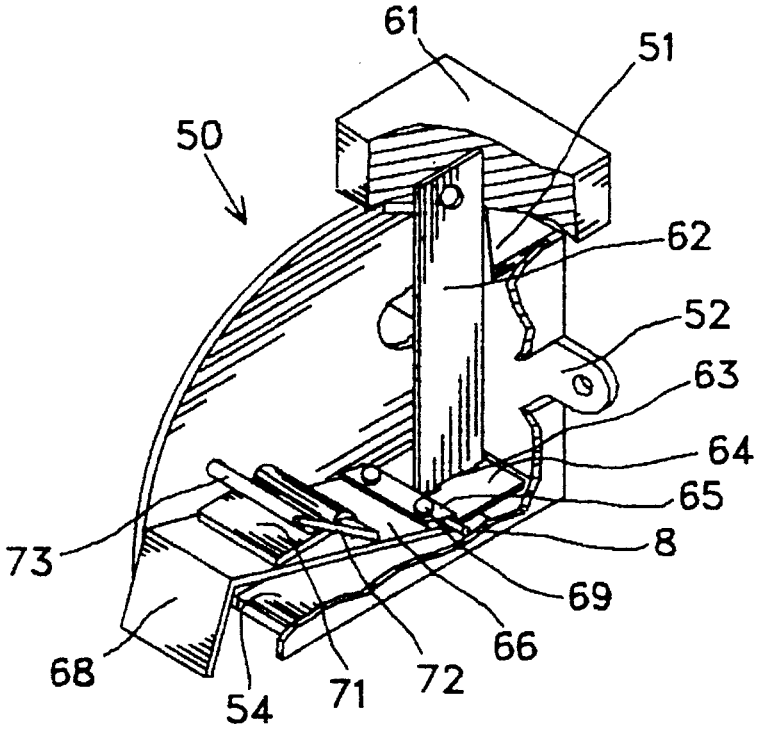
FIGS. 1A and 1B are views of the Earthquake Actuated Door Latch with the side of the enclosure and part of the weight cut away to reveal the working parts and to show the "cocked" and "operated" positions of the mechanism.

Reference Numerals In Drawings:

| | | |
|---|---|---|
| 8. Hinge pin | 53. Spot weld | 64. Arm platform |
| 9. Strike plate | 54. Bottom | 65. Stay |
| 10. Door latch | 55. Upper lock stop hole | 66. Latch flap |
| 11. Cabinet frame | 56. Reset lever hole | 67. Lower lock stop |
| 12. Door | 57. Hinge pin hole | 68. Hook |
| 41. Hinge pin hole | 58. Mounting hole | 69. Rivets |
| 42. Arm tabs | 60. Latch assembly | 70. Lock |
| 50. Enclosure | 61. Weight | 71. Lock flap |
| 51. V-slot | 62. Arm | 72. Reset lever |
| 52. Mounting tab | 63. Arm joint | 73. Upper lock stop |

DESCRIPTION OF THE PREFERRED EMBODIMENT

Figure 1B:
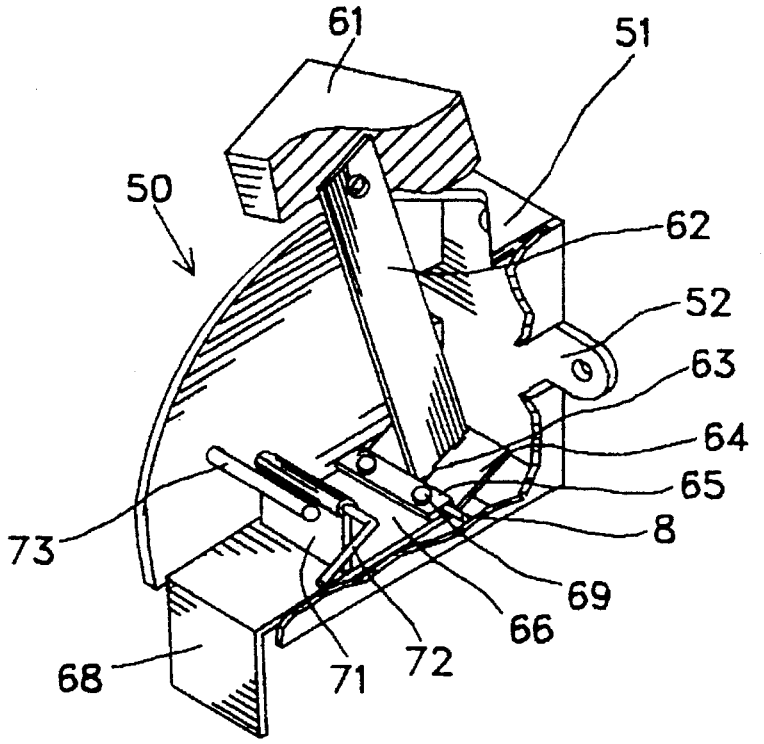

FIGS. 1A and 1B show the complete door latch assembly. An enclosure 50 is sheet material formed into two sides, a bottom 54, mounting tabs 52, and a V-slot 51. A weight 61 securely fastened to an arm 62, is joined 63 to arm platform 64. Arm 62 and weight 61 can rock laterally on arm platform 64. Latch flap 66 is a continuation of arm platform 64 and is hinged using a hinge pin 8 inserted through holes in enclosure 50. The entire catch assembly including weight 61, arm 62, arm platform 64, and a hook 68, can rock on hinge pin 8 while weight 61 and arm 62 can also rock at a right angle to this motion at arm joint 63. Catch assembly 60 is shown in the cocked position with arm 62 resting in V-slat 51. A lock flap 71 rests on top of latch flap 66 when catch assembly 60 is in the cocked position as shown. Reset lever 72 is a hinge for lock 70 as well as a handle for manual control of lock flap 71. The two pieces (reset lever 72 and lock flap 71) are bonded together. Upper lock stop 73 is a pin located just above lock flap 71 to limit upward movement of the lock flap 71.

Figure 2A:
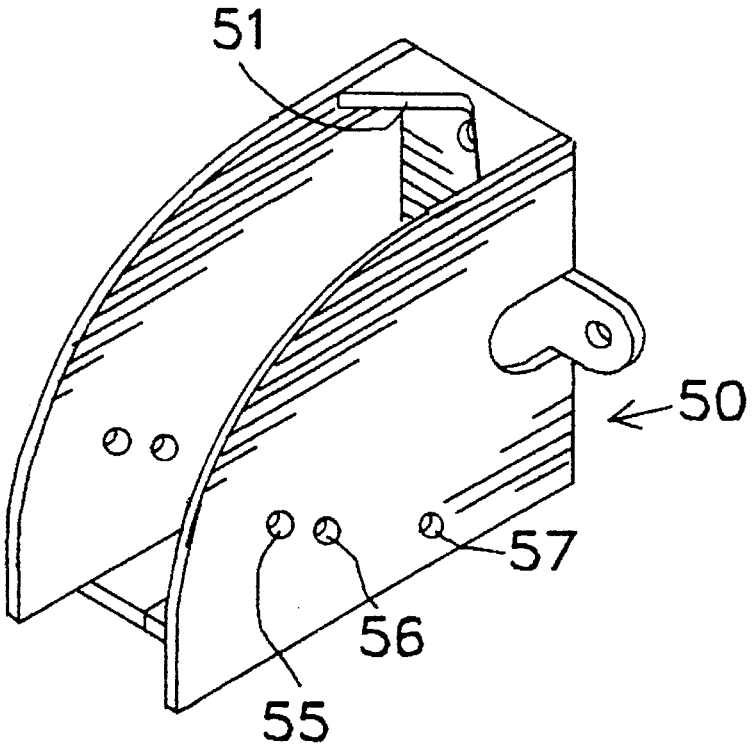
FIG. 2A shows the entire enclosure and FIG. 2B shows the enclosure with the near side cut away to reveal the bottom construction.
Figure 2B:
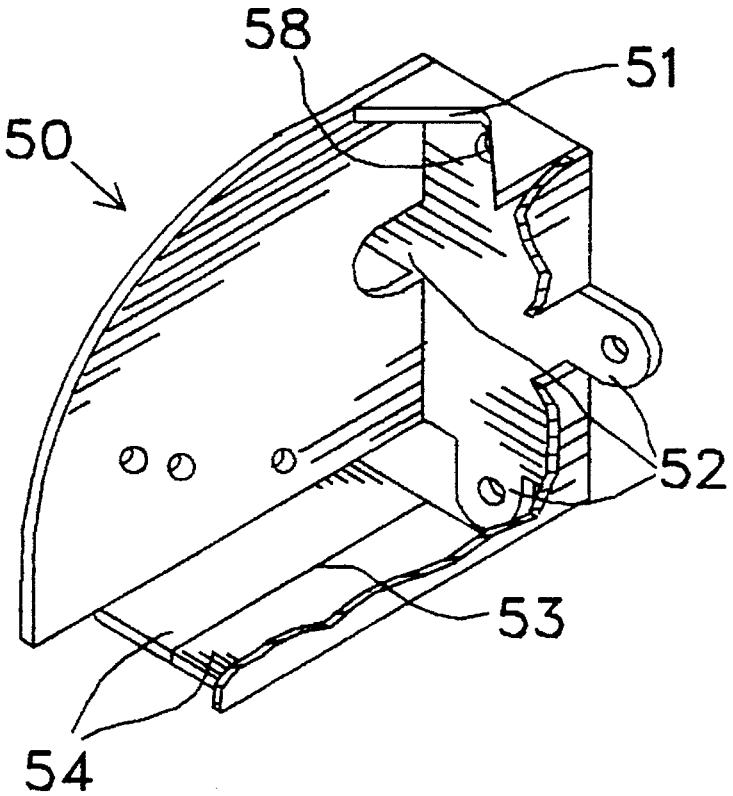

Enclosure 50 is sheet material formed as shown in FIGS. 2A and 2B. The bottom 54 is two wide tabs bent inwards and welded together 53 for structural strength. Three stamped mounting tabs 52 are shown as part of the rear surface and an additional hole 58 for mounting is located near the top of the rear surface. The two side mounting tabs may be broken off when not used, as for beside-door mounting, or the bottom tab may be broken off for above-door mounting. A V-slot 51 tab at the top is bent forward at a right angle to the rear surface. Three holes, upper lock stop hole 55, reset lever hole 56, and hinge pin hole 57, are drilled or stamped'in each side of the enclosure for insertion of upper lock stop 73, reset lever 72, and hinge pin 8, all shown in FIGS. 1A and 1B.

Figure 3:
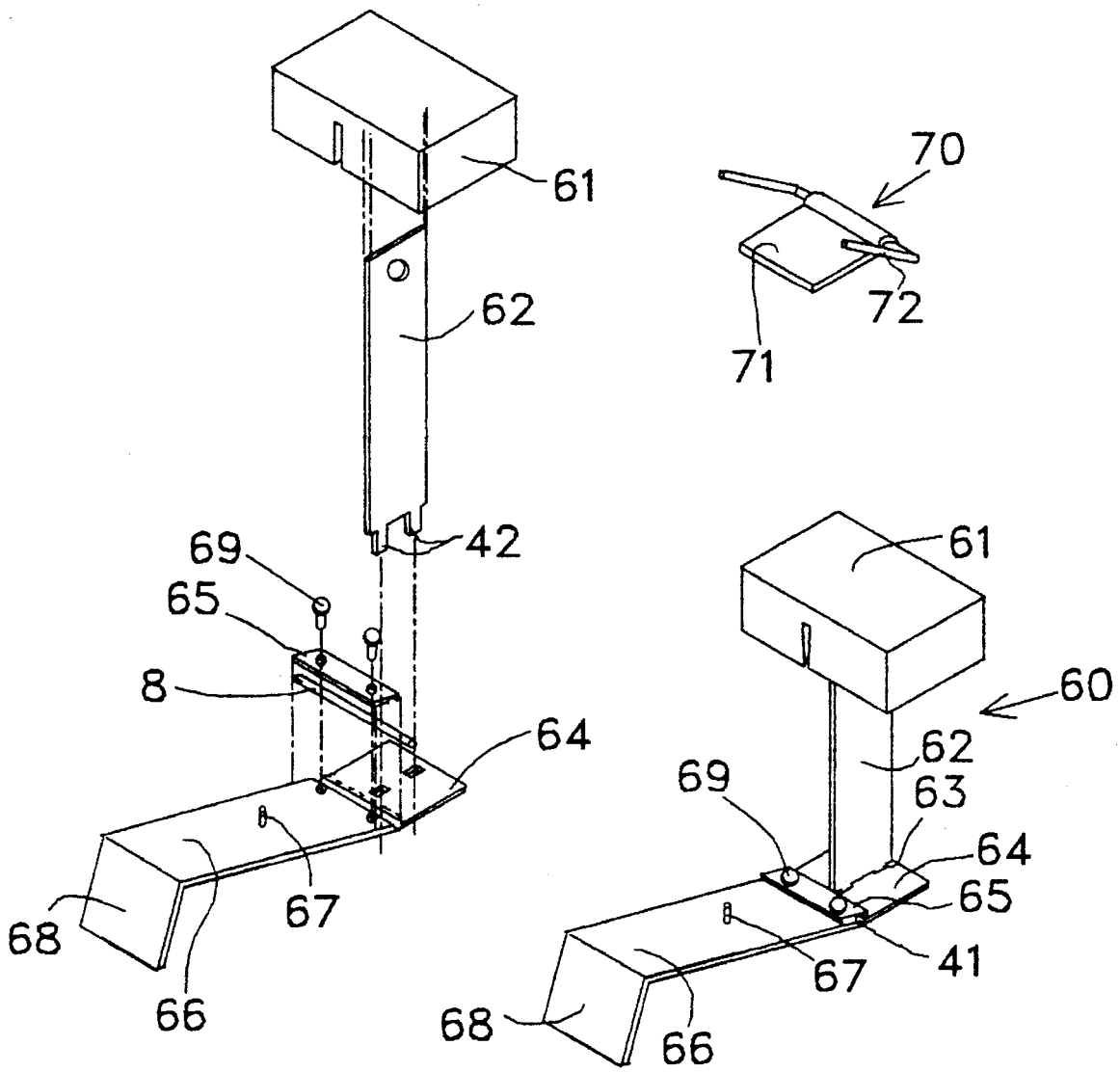
FIG. 3 shows catch assembly details and details of the lock.

FIG. 3 shows catch assembly and lock details. A lead weight 61 is firmly attached to the top end of arm 62. The bottom end of arm 62 is loosely joined to arm platform 64 by insertion of two tabs 42 into holes in the arm platform and twisting or bending of the tabs. This allows lateral movement of the top end of the arm. A stay 65, for strengthening, is fastened to latch flap 66 with two rivets 69. There is a hole through latch flap 66 and stay 65 to be used for hinging catch assembly 60 to enclosure 50. Latch flap 66 is bent slightly between arm platform 64 and stay 65 so that hook 68 will clear the cabinet door when arm platform 64 is horizontal. A lower lock stop 67 (a screw, peg, or tab) is inserted in latch flap 66 to limit movement of lock flap 71 in its lower position. Lock flap 71 and reset lever 72 are crimped or welded after installing in the enclosure so that they will move as a unit.

Figure 4A:
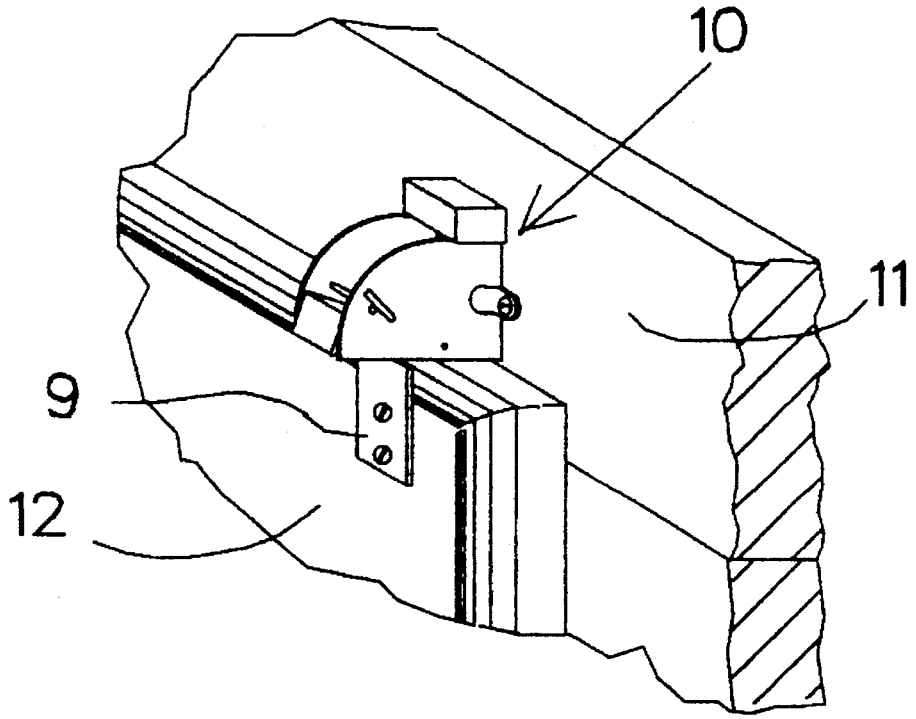
FIG. 4A shows a typical installation of the latch above a cabinet door and FIG. 4B shows installation of the latch beside a cabinet door.
Figure 4B:
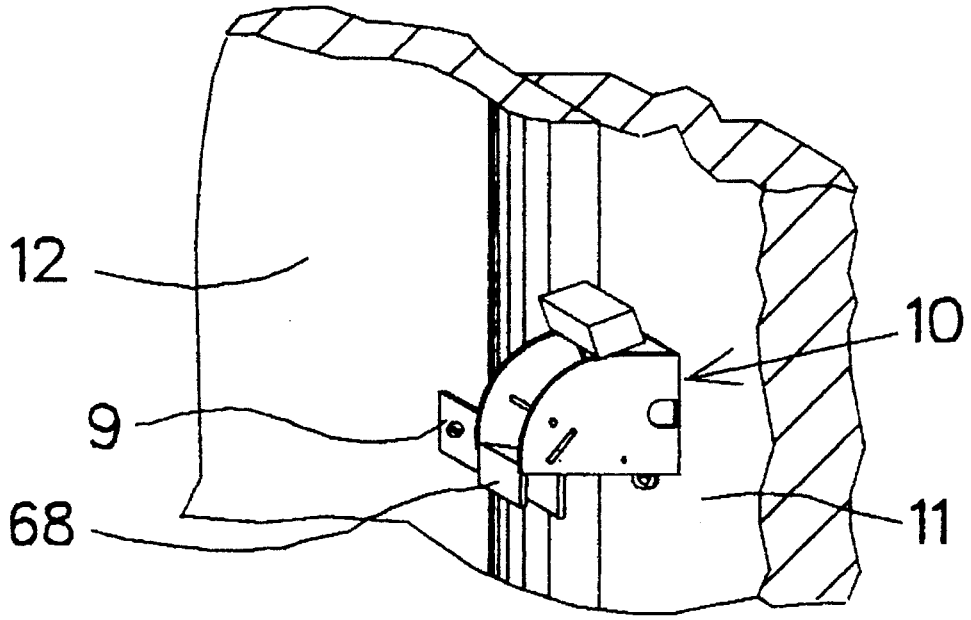

FIG. 4A shows door latch 10 mounted on cabinet frame 11 just above a door 12. Door 12, having a rounded edge, requires a strike plate 9 so that hook 68 can interfere with door opening. With the latch cocked as shown in FIG. 4A door 12 may be opened and closed without interference. FIG. 4B shows door latch 10 mounted beside door 12. A strike plate 9 is required in all cases for beside-door mounting. When an earth tremor occurs the latch operates, as shown in FIG. 4B, and door 12 can move only a slight amount before being stopped by hook 68.

THEORY OF OPERATION

Operation of the latch is based on a weight supported on a hinged latch assembly that has two stable positions. One stable position is with the weight to the rear and the latch hook raised. The other stable position is with the the weight forward and the latch hook lowered. Facing a cabinet with the unit mounted above a door, the weight and arm rest in a V-shaped slot projecting from behind. The weight is centered laterally by the V-shaped slot. The arm and weight are behind the center of balance and will remain there unless disturbed by motion of the cabinet. A latch flap and hook attached to the arm platform are raised and do not interfere with the cabinet door. Motion of the cabinet, causes the weight to move out of this rest position past the center of balance and it remains then in the operated or latched position forward of the center of balance. This places the hook in front of the cabinet door, preventing the door from opening.

Lateral motion of the cabinet causes the sides of the V-slot to push against the arm urging the weight forward. Forward-backward motions of the cabinet cause the weight to move toward the center of balance either by being shoved in that direction or by the cabinet moving away and inertia carrying the weight forward. A locking device is included to prevent the catch assembly from rebounding after it has operated. Sensitivity of the latch is determined by mass of the weight and how far it must move to latch the door. Size of the latch is determined by strength requirements of the door to be controlled.

DESCRIPTION OF OPERATION-FIGS. 1 AND 3

FIG. 3 shows the moving parts involved in operation of the door latch, FIGS. 1A and 1B show the two stable positions of the moving parts. Weight 61, firmly attached to arm 62 is allowed sidewards movement at its joint 63 with arm platform 64. A hinge pin 8 is inserted through hinge pin hole 41 in stay 65 and latch flap and through hinge pin hole 57 in enclosure 50 to form a hinged balance point for catch assembly 60. The door latch is stable in the cocked position depicted in FIG. 1A. Cabinet motion rocks weight 61 and arm 62 either sideways against V-slot 51 or forward and reverse causing the weight to move forward pushing latch flap 66 to where it rests on bottom 54. Lock flap 71 rotates downward with latch flap 66 until lock flap 71 hangs vertically above latch flap 66. This condition is shown in FIG. 1B.

LOCK-FIGS. 1 AND 3

Lock 70 is necessary to prevent unwanted return of latch flap 66 to the open, or cocked, position. The lack comprises lack flap 71, reset lever 72, upper lack stop 73, and lower lack stop 67. Manually raising reset lever 72 rotates lack flap 71 upwards to upper lack stop 73, and this allows reset of catch assembly 60 to the cocked position by manual pushing of weight 61 to the rear. When motion causes latch flap 66 to move down to its lower position lack flap 71 follows until lack flap 71 hangs vertical and further rotation is prevented by lower lack stop 67. With lack flap 71 vertical, latch flap 66 is locked into its latched position until manually released.

RAMIFICATIONS AND SCOPE

The Earthquake Actuated Door Latch described above operates on a unique principle that involves only one motion rather than a series of motions that previously patented devices use. The moving pods of this latch move a shorter distance than the gap that is allowed for door movement and the parts have less friction than the door, so the latch is sure to operate faster than the door. The latch described may be made small and attractive for use in any modern designer kitchen. Brass materials, painted finishes, or other finishes commonly used on hinges and knobs could be used and the shape might be streamlined. The design described may be used for above-door mounting, for mounting beside a door, or between two doors.

Though the foregoing description is somewhat specific it is an example of the presently preferred embodiment and should not be construed as limiting the scope of the invention. Examples of variations follow: The dimensions may be scaled up or down to accommodate heavier duty or lighter duty requirements. The unit could be reconfigured to operate a switch rather than a door catch, permitting earthquake control of anything electronic.

The scope of the invention should be determined by the claims and their legal equivalents, rather than by the examples given.

I claim:

1. A latch for automatically securing a cabinet door during an earthquake comprising:

an enclosure operating as supporting structure for mounting to a cabinet surface;

a catch assembly comprising: an L-shaped rigid strap, a hook attached to a lower extremity of said rigid strap, a lead weight attached to a top end of said rigid strap, wherein said rigid strap pivots at the bend of the L shape, wherein the weighted end is capable of pivoting over a limited arc in any direction within the confines of said enclosure, said catch assembly having two stable positions within the confines of the enclosure: a cocked position, wherein said hook is raised, and, an operated position, wherein said hook is lowered; said catch assembly being so positioned within said enclosure that in said cocked position said hook remains within said enclosure, and in said operated position said hook extends below said enclosure;

a lock as a means of preventing said catch assembly from leaving said operated position without manual assistance;

means for securing said enclosure to a mounting surface;

a V-shaped horizontal slot at the back of said enclosure that interfaces with with said catch assembly as a means of converting sideways motion of said enclosure to forward motion of said catch assembly weight.

2. A latch of claim 1, wherein said catch assembly comprises:

said rigid strap formed into a latch flap with said hook bent down at a right angle to one end and an arm platform bent slightly upward at the other end;

means for pivoting said latch flap and supporting it within said enclosure located at the juncture of said latch flap and said arm platform;

an arm with said weight affixed to the top end, and the bottom end of said arm being flexibly attached to said arm platform to permit lateral motion.

3. A latch for automatically securing a cabinet door during an earthquake comprising:

an enclosure operating as supporting structure for mounting to a cabinet surface;

a catch assembly comprising: an L-shaped rigid strap, a hook attached to a lower extremity of said rigid strap, a lead weight attached to a top end of said rigid strap, wherein said rigid strap pivots at the bend of the L shape, wherein the weighted end is capable of of pivoting over a limited arc in any direction within the confines of said enclosure, said catch assembly having two stable positions within the the confines of the enclosure: a cocked position, wherein said hook is raised, and, an operated position, wherein said hook is lowered; said catch assembly being so positioned within said enclosure that in said cocked position said hook remains within said enclosure, and in said operated position said hook extends below said enclosure;

a lock as a means of preventing said catch assembly from leaving said operated position without manual assistance;

means for securing said enclosure to a mounting surface; wherein a flap hinged above said catch assembly rests horizontally on the cocked catch assembly and hangs vertically above the operated catch assembly to block upward movement of said catch assembly;

and means for manual release of said lock comprising a reset lever fastened to said flap extending out each side of said enclosure.

* * * * *